US006952888B2

(12) United States Patent
Nagano et al.

(10) Patent No.: US 6,952,888 B2
(45) Date of Patent: Oct. 11, 2005

(54) DRYER VACUUM BOX

(75) Inventors: Akihito Nagano, Hiroshima-ken (JP); Takashi Nagaoka, Hiroshima-ken (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 10/446,016

(22) Filed: May 28, 2003

(65) Prior Publication Data

US 2003/0230002 A1 Dec. 18, 2003

(30) Foreign Application Priority Data

May 30, 2002 (JP) ..... 2002-157672
Jul. 25, 2002 (JP) ..... 2002-216775

(51) Int. Cl.[7] ..... F26B 11/02
(52) U.S. Cl. ..... 34/119
(58) Field of Search ..... 34/116, 117, 118, 34/119; 162/206, 207

(56) References Cited

U.S. PATENT DOCUMENTS 4,876,803 A 10/1989 Wedel
4,905,380 A 3/1990 Eskelinen et al.
5,163,236 A 11/1992 Heikkilä
5,241,761 A * 9/1993 Hauser ..... 34/117
5,341,579 A 8/1994 Schiel et al.
5,515,619 A * 5/1996 Kahl et al. ..... 34/114
5,600,897 A 2/1997 Sollinger et al.
5,782,009 A * 7/1998 Kotitschke ..... 34/117
5,829,164 A * 11/1998 Kotitschke ..... 34/453
5,873,180 A 2/1999 Grunder
6,189,233 B1 * 2/2001 Halmschlager et al. ..... 34/117

FOREIGN PATENT DOCUMENTS

| | | |
|---|---|---|
| DE | 4314475 A1 | 12/1993 |
| EP | 1193343 A2 | 4/2002 |
| JP | 64-85390 | 3/1989 |
| JP | 3-137288 | 6/1991 |
| JP | 6-294090 | 10/1994 |
| JP | 10-110397 | 4/1998 |
| WO | 00/50692 | 8/2000 |
| WO | 00/50693 | 8/2000 |

* cited by examiner

*Primary Examiner*—Stephen Gravini
(74) *Attorney, Agent, or Firm*—Wenderoth, Lind & Ponack, L.L.P.

(57) ABSTRACT

A dryer vacuum box suppresses occurrence of sticking at an exit portion of a dryer roll in a dryer part of a paper machine to prevent paper break in the dryer part of the paper machine upon high speed paper making. The dryer vacuum box is provided for applying a vacuum suction force generated by a vacuum source through a canvas to a paper web. A first vacuum box has an opening faced with a surrounding area of a peeling point on the canvas, where the canvas is separated from the circumferential surface of the dryer roll, and the opening is covered by the surrounding area of the canvas so that an enclosed space is defined within the first vacuum box. The first vacuum box is connected with the vacuum source so that the a degree of vacuum in the first vacuum box is set to a predetermined value.

13 Claims, 11 Drawing Sheets

8: PAPER WEB
22: SIDE SEAL
32, 34: CROSS SEAL
40: SUPPORT PIPE
44, 46: BRACKET
48: VACUUM INTRODUCTION PATH
70: CANVAS ROLL
80: CANVAS
90: FIRST VACUUM BOX 2, 4: DRYER ROLL
6: CANVAS
10: VACUUM ROLL
10a, 10b, 10c: VACUUM CHAMBER
20: SECOND VACUUM BOX
22: SIDE SEAL
26, 28: CROSS SEAL
30: FIRST VACUUM BOX
32, 34: CROSS SEAL
40: SUPPORT PIPE
42, 44, 46: BRACKET
48: VACUUM INTRODUCTION PATH

4:DRYER ROLL
6:CANVAS
8:PAPER WEB
10:VACUUM ROLL
20:SECOND VACUUM BOX
22, 24:SIDE SEAL
26:CROSS SEAL
30:FIRST VACUUM BOX
32, 34:CROSS SEAL
36:SIDE SEAL
40:SUPPORT PIPE
50:VACUUM FAN

8: PAPER WEB
60 TO 63: DRYER ROLL
70 TO 73: CANVAS ROLL 80, 81: CANVAS
90, 91: FIRST VACUUM BOX

8: PAPER WEB
22: SIDE SEAL
32, 34: CROSS SEAL
40: SUPPORT PIPE
44, 46: BRACKET
48: VACUUM INTRODUCTION PATH
70: CANVAS ROLL
80: CANVAS
90: FIRST VACUUM BOX

DRYER VACUUM BOX

BACKGROUND OF THE INVENTION

1) Field of the Invention

This invention relates to a dryer vacuum box incorporated in a dryer part of a paper machine.

2) Description of the Related Art

A conventional paper machine employs a dryer part of, for example, (1) the single deck type wherein dryer rolls are juxtaposed in one stage or (2) the double deck type wherein dryer rolls are juxtaposed in two stages. Dryer parts of the types mentioned are described below.

(1) Single Deck Type

In a dryer part of the single deck type, a plurality of dryer rolls are disposed in an upper stage while a plurality of vacuum rolls are disposed in a lower stage, and a belt-like canvas is wrapped alternately around the dryer rolls and the vacuum rolls. A paper web (wet-web) dehydrated by an upstream press part runs alternately between and around the dryer rolls and the vacuum rolls while it is supported at one face thereof by the canvas. The paper web is supported on the lower face side of the canvas, and on each of the dryer rolls, the paper web is pressed to the surface of the dryer roll by the canvas and dried by heat of the dryer roll.

The paper web heated and dried by each of the dryer rolls advances to one of the vacuum rolls together with the canvas. When the paper web is spaced away from the dryer roll, sticking, such that the paper web sticks to the surface of the dryer roll sometimes occurs. The sticking is considered to be a phenomenon which occurs because paper powder sticking to the surface of the dryer roll acts as if it were paste, pasting the paper web to the surface of the dryer roll. If such sticking occurs, then the paper web is taken by the dryer roll side and spaced away from the canvas. Consequently, running of the paper web is disordered, and in the worst case, a break of the paper web occurs.

Therefore, the dryer part of a conventional paper machine includes a vacuum box such as shown in FIGS. 9 and 10 as a running stabilization apparatus for a paper web in order to suppress disorderly running of a paper web in a draw section from a dryer roll to a vacuum roll. FIG. 9 is a side elevational view partly in section showing a configuration of a conventional vacuum box, and FIG. 10 is a front elevational view of the vacuum box. Referring to FIGS. 9 and 10, two side seals 22 and 24 and two cross seals 26 and 28 are disposed among two adjacent dryer rolls 2 and 4 and a vacuum roll 10. The side seals 22 and 24 and the cross seals 26 and 28 are secured to and supported on a support pipe 40 disposed between the dryer rolls 2 and 4 and extending in a widthwise direction of the apparatus. The side seals 22 and 24 are shaped in conformity with the shape of a side section of a space defined by a portion of a canvas 6 from the dryer roll 2 to the vacuum roll 10, the vacuum roll 10, and another portion of the canvas 6 from the vacuum roll 10 to the dryer roll 4, and are disposed in a spaced relationship from each other by a distance substantially equal to the width W of a paper web 8 in the widthwise direction of the apparatus. The cross seals 26 and 28 are disposed in the widthwise direction of the apparatus between the side seals 22 and 24 and secured to a bracket 42 securely mounted at an upper end portion of the support pipe 40. One of the cross seals 26 and 28, that is, the cross seal 26, is secured to an end portion of the bracket 42 adjacent the dryer roll 2 and serves as a lid for a gap between the bracket 42 and the canvas 6 wrapped around the dryer roll 2. The other cross seal 28 is secured to an end portion of the bracket 42 adjacent the dryer roll 4 and serves as a lid for a gap between the bracket 42 and the canvas 6 wrapped around the dryer roll 4. An enclosed space 20 is defined by the side seals 22 and 24, cross seals 26 and 28, vacuum roll 10 and portions of the canvas 6, and the enclosed space 20 functions as a vacuum box 20 as a running stabilization apparatus for the paper web 8.

The inside of the vacuum roll 10 is partitioned into a plurality of chambers 10*a*, 10*b*, 10*c* and 10*d* in a circumferential direction by partition plates 14 as shown in FIG. 9, and the chambers 10*a*, 10*b* and 10*c*, along which the canvas 6 is wrapped, serve as vacuum chambers which are acted upon by vacuum suction force from a vacuum introduction path 12 disposed at the center of the vacuum roll 10. A plurality of holes are perforated in a surface cell of the vacuum roll 10 in such a manner as to establish a communication state between the entrance and exit side chambers 10*a* and 10*c* and the vacuum box 20 so that vacuum suction force acts in the vacuum box 20 from the chambers 10*a* and 10*c*. The inside of the vacuum box 20 is in a lower pressure state than the outside of the vacuum box 20 due to the vacuum suction force from the vacuum roll 10 so that, through the canvas 6 having air-permeability, suction force acts upon the paper web 8 accompanied by the canvas 6. The paper web 8 is constrained compulsorily to the canvas 6 by the suction force, and disordering of the running of the paper web 8 in the draw section from the dryer roll 2 to the vacuum roll 10 is suppressed.

It is to be noted that one apparatus which includes such a vacuum box as described above is disclosed particularly in Japanese Patent Laid-Open (Kokai) No. HEI 3-137288.

Meanwhile, in an apparatus disclosed in U.S. Pat. No. 4,905,380, a nozzle is provided in an opposing relationship to a draw section of canvas from a dryer roll (drying cylinder) to a suction roll in a dryer part of the single deck type, and air is jetted from the nozzle along the draw section so that a paper web may be sucked to the canvas in the draw section by an ejector effect of the air.

(2) Double Deck Type

In a dryer part of the double deck type, a plurality of dryer rolls are disposed at each of two stages of an upper stage and a lower stage, and canvas is wrapped around the dryer rolls. A paper web (wet-web) from a press part runs alternately between and around the dryer rolls in the upper stage and the dryer rolls in the lower stage while it is supported by the canvas. The paper web is heated and dried directly by the dryer rolls or indirectly through the canvas in the process of running around the circumferential faces of the dryer rolls.

In such a dryer part of the double deck type as just described, there is the possibility that sticking may occur when the paper web is to be spaced away from a dryer roll, and an apparatus disclosed as prior art, for example, in U.S. Pat. No. 4,876,803 is available as an apparatus which can prevent such sticking. The apparatus has a configuration such as shown in FIG. 11. Referring to FIG. 11, dryer rolls 160, 162 and 164 are disposed in an upper stage while dryer rolls 161, 163 and 165 are disposed in a lower stage. A paper web 8 is heated and dried by the dryer rolls 160 to 165 in a process of passage through while it is supported by canvas 170 or another canvas 171. In a loop of the canvas 170, blowers 190 and 191 are disposed between the dryer rolls 160 and 161 and between the dryer rolls 162 and 163, respectively.

Each of the blowers 190 and 191 jets air as indicated by an arrow mark A. Consequently, a negative pressure is generated in the loop of the canvas 170 by an ejector effect of the jetted air. As a result, the paper web 8 is sucked to the canvas 170 so that disorderly running of the paper web 8 can be suppressed to prevent otherwise possible sticking.

If sticking occurs, then the paper web 8 is taken by a greater amount by a dryer roll as the running speed of the paper web 8, that is, the paper speed, increases. Although development of a high speed paper machine which makes paper at a paper speed higher than 2,000 m/minute is proceeding these days, if sticking occurs with such a high speed paper machine as just described, then paper break occurs with a high probability, which causes deterioration of the availability of the paper machine and production of a large amount of paper loss. Particularly at such a very high paper making speed, which exceeds 2,000 m/minute, where such a vacuum box 20 as shown in FIGS. 9 and 10 is provided, since a negative pressure acts upon the vacuum box 20 through the vacuum roll 10, a sufficiently high degree of vacuum cannot be obtained. On the other hand, where such an apparatus as disclosed in U.S. Pat. No. 4,905,380 mentioned hereinabove or such blowers 190 and 191 as shown in FIG. 11 are provided, since a negative pressure acts due to an ejector effect, a sufficiently high degree of vacuum cannot be obtained. Consequently, in both cases, it is difficult to sufficiently suppress disorderly running of the paper web 8 caused by sticking.

Meanwhile, when a paper web is to be threaded through the dryer part of a paper machine, where the paper machine is o f the single deck type, referring particularly to FIG. 10, the paper web 8 is cut to form a tail 8*a* of a reduced width T and the tail 8*a* is threaded to a reel, whereafter the width of the paper web is increased to the full width W thereof. However, if sticking occurs and an end of the tail is taken by the dryer roll 2, then the paper web cannot be threaded any more, and consequently, it becomes required to perform a paper threading operation once again from the beginning.

SUMMARY OF THE INVENTION

It is an object of the present invention to provide a dryer vacuum box which suppresses the occurrence of sticking at an exit portion of a dryer roll to prevent paper break in a dryer part of a paper machine upon high speed paper making.

It is another object of the present invention to provide a dryer vacuum box wherein the occurrence of sticking at an exit portion of a dryer roll can be suppressed to allow a tail of a paper web to be readily threaded.

In order to attain the objects described above, according to an aspect of the present invention, a dryer vacuum box is provided in a dryer part of a paper machine for applying vacuum suction force generated by a vacuum source through a canvas to a paper web which is delivered with the canvas on a circumferential surface of a dryer roll. The box comprises a first vacuum box having an opening faced with a surrounding area of a peeling point on the canvas, where the canvas is separated from the circumferential surface of the dryer roll. The opening is covered by the surrounding area of the canvas so that an enclosed space is defined within the first vacuum box. The first vacuum box is connected with the vacuum source so that a degree of vacuum in the first vacuum box can be set to a predetermined value.

With the dryer vacuum box having such a configuration as just described, since vacuum suction force of a high degree of vacuum can be applied in the proximity of the peeling point from the dryer roll, at which sticking is likely to occur, with the first vacuum box, the paper web having passed the peeling point can be constrained immediately to the canvas before it is taken by the dryer roll. Consequently, the occurrence of sticking can be suppressed. Consequently, a paper break in the dryer part of a paper machine upon high speed paper making can be prevented, and also threading of a tail of the paper web is facilitated.

Preferably, the dryer vacuum box further comprises a second vacuum box having an opening faced with a draw area of the canvas, which area lies between the dryer roll and another roll on the downstream side along a path of the paper web. The opening is covered by the draw area of the canvas so that another enclosed space is defined within the second vacuum box and that vacuum suction force is applied to inside of the said second vacuum box. The first vacuum box is provided in the second vacuum box, and the degree of vacuum in the first vacuum box is set higher than a degree of vacuum in the second vacuum box.

More preferably, the second vacuum box is provided where the dryer part of a paper machine to which the dryer vacuum box of the present invention is applied is of the single deck type, wherein a plurality of dryer rolls and a plurality of vacuum rolls are alternately disposed in an offset relationship in upward and downward directions from each other and a canvas which supports one face of the paper web is successively wrapped around the dryer rolls and the vacuum rolls such that the paper web is pressed to a surface of each of the dryer rolls. In this instance, another roll is a vacuum roll and the vacuum suction force generated from the vacuum roll is applied to the inside of the second vacuum box.

With the dryer vacuum box which includes the second vacuum box having a configuration such as described above, a vacuum suction force can be applied to the paper web utilizing the vacuum suction force of the vacuum roll with the second vacuum box also after the paper web passes by the peeling point. Consequently, the paper web can be constrained with certainty to the canvas until it reaches the vacuum roll so that running of the paper web can be stabilized.

It is to be noted that the first vacuum box may be formed so as to have a width substantially equal to the full width of the paper web, or alternatively the first vacuum box may be formed so as to have a width substantially equal to the width of a tail of the paper web upon paper threading and provided at a paper threading position of the tail. In the former case, a high vacuum suction force can be uniformly applied not only to the paper web having a full width but also to the tail upon paper threading. In the latter case, the high vacuum suction force is applied only to the tail. However, where the problem of sticking of the paper web during main driving does not occur and rather, where paper threading of the tail is difficult due to such sticking, the first vacuum box is provided restrictively at the paper threading position of the tail so that the vacuum suction force can be applied to the paper web efficiently and the load to the vacuum source can be reduced.

Where the first vacuum box has a width substantially equal to the full width of the paper web, it is preferred that the inside of the first vacuum box is partitioned in a widthwise direction into a first chamber and a second chamber which can be connected to the vacuum source independently of each other, and the first chamber has a width substantially equal to the width of the tail upon paper threading and provided at a paper threading position of the tail. With the dryer vacuum box having the configuration just described, upon paper threading of the tail, the second chamber is closed. Consequently, the vacuum suction force can be applied only to the paper threading position of the tail. However, upon main operation of the dryer vacuum box wherein the paper web is extended to the full width, the second chamber is opened. Consequently, the high vacuum suction force can be applied uniformly to the full width of the paper web. In both cases, the occurrence of sticking can be suppressed.

The above and other objects, features and advantages of the present invention will become apparent from the following description and the appended claims, taken in conjunction with the accompanying drawings in which like parts or elements are denoted by like reference symbols.

DESCRIPTION OF THE PREFERRED EMBODIMENTS

In the following, preferred embodiments of the present invention are described with reference to the drawings. It is to be noted that the first to third embodiments incorporate a dryer vacuum box of the present invention in a dryer part of the single deck type while the fourth and fifth embodiments incorporate the dryer vacuum box of the present invention in a dryer part of the double deck type.

A. First Embodiment

A dryer vacuum box in this embodiment is provided in a dryer part of a paper machine, and is operable to apply vacuum suction force generated by a vacuum source through a canvas to a paper web, which is delivered with the canvas on the circumferential surface of a dryer roll. The dryer vacuum box comprises a first vacuum box having an opening faced with the surrounding area of a peeling point on the canvas, where the canvas is separated from the circumferential surface of the dryer roll, and the opening is covered by the surrounding area of the canvas so that an enclosed space is defined within the first vacuum box. The first vacuum box is connected with the vacuum source so that the degree of vacuum in the first vacuum box can be set to a predetermined value.

And the dryer vacuum box in this embodiment further comprises a second vacuum box having an opening faced with a draw area of the canvas, which area lies between the dryer roll and another roll on the downstream side along a path of the paper web, and the opening being covered by the draw area of the canvas so that another enclosed space is defined within the second vacuum box and that vacuum suction force is applied to the inside of the second vacuum-box. The first vacuumbox is provided in the second vacuum box, and the degree of vacuum in the first vacuum box is set higher than the degree of vacuum in the second vacuum box.

In addition, in this embodiment, the other roll is a vacuum roll and the vacuum suction force generated from the vacuum roll is applied to the inside of the second vacuum box.

The dryer vacuum box in this embodiment is explained in detail by following description.

Figure 1:
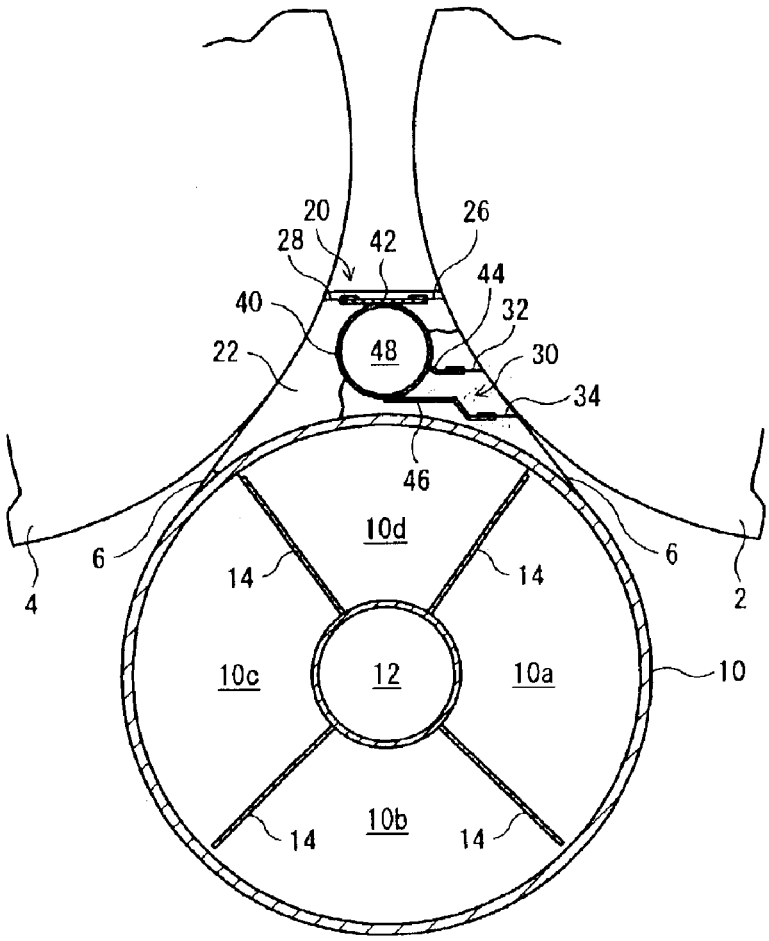
FIG. 1 is a side elevational view, partly in section, showing a configuration of a dryer vacuum box according to a first embodiment of the present invention.
Figure 2:
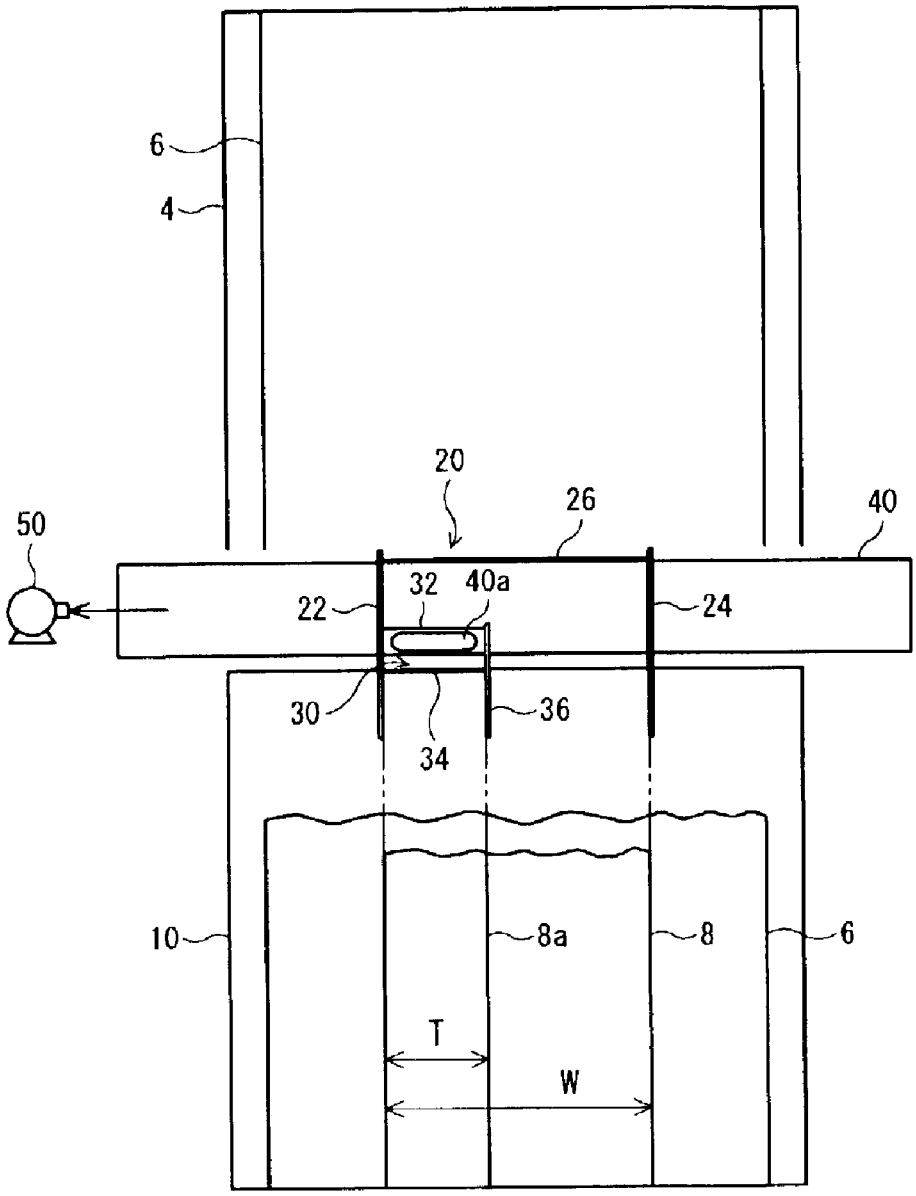
FIG. 2 is a front elevational view showing a configuration of the dryer vacuum box according to the first embodiment of the present invention.
Figure 9:
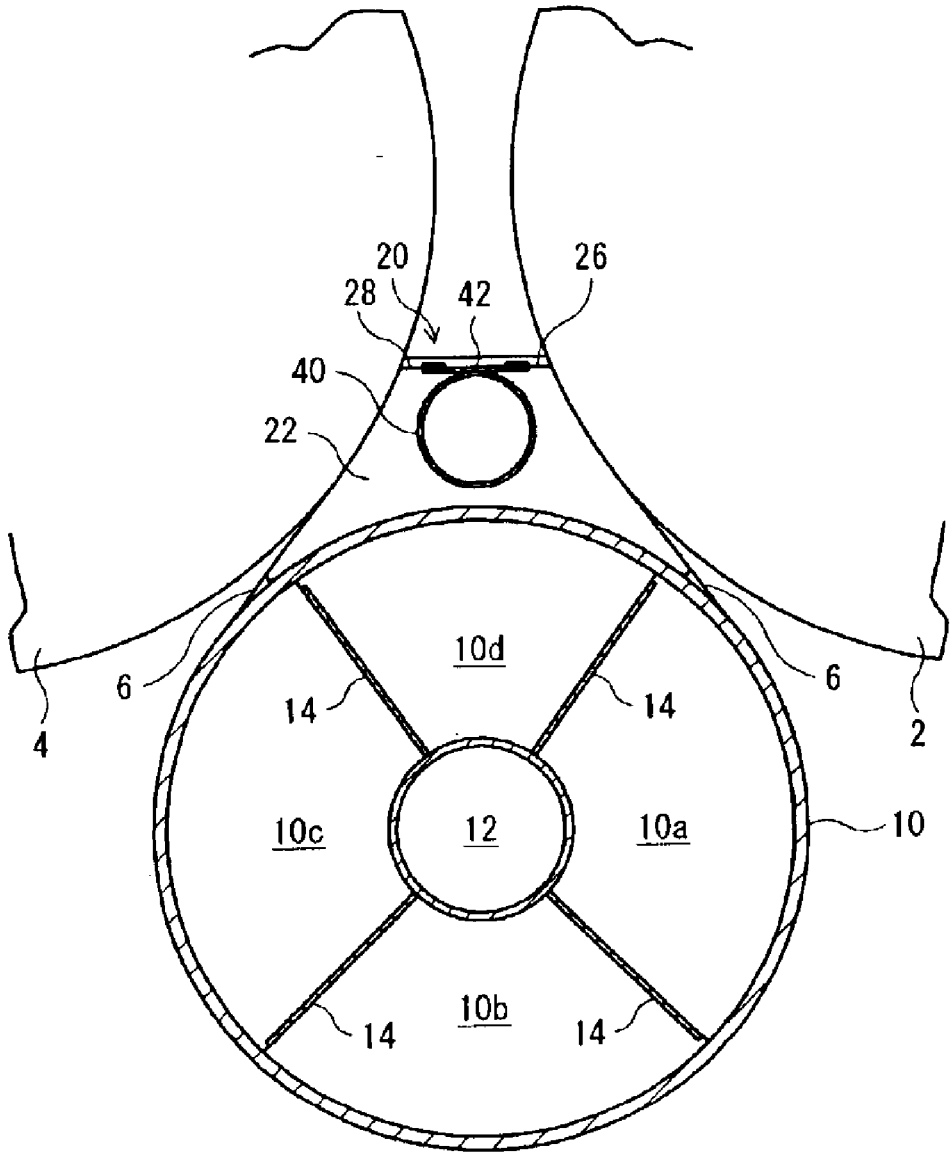
FIG. 9 is a side elevational view, partly in section, showing a configuration of a conventional dryer vacuum box.
Figure 10:
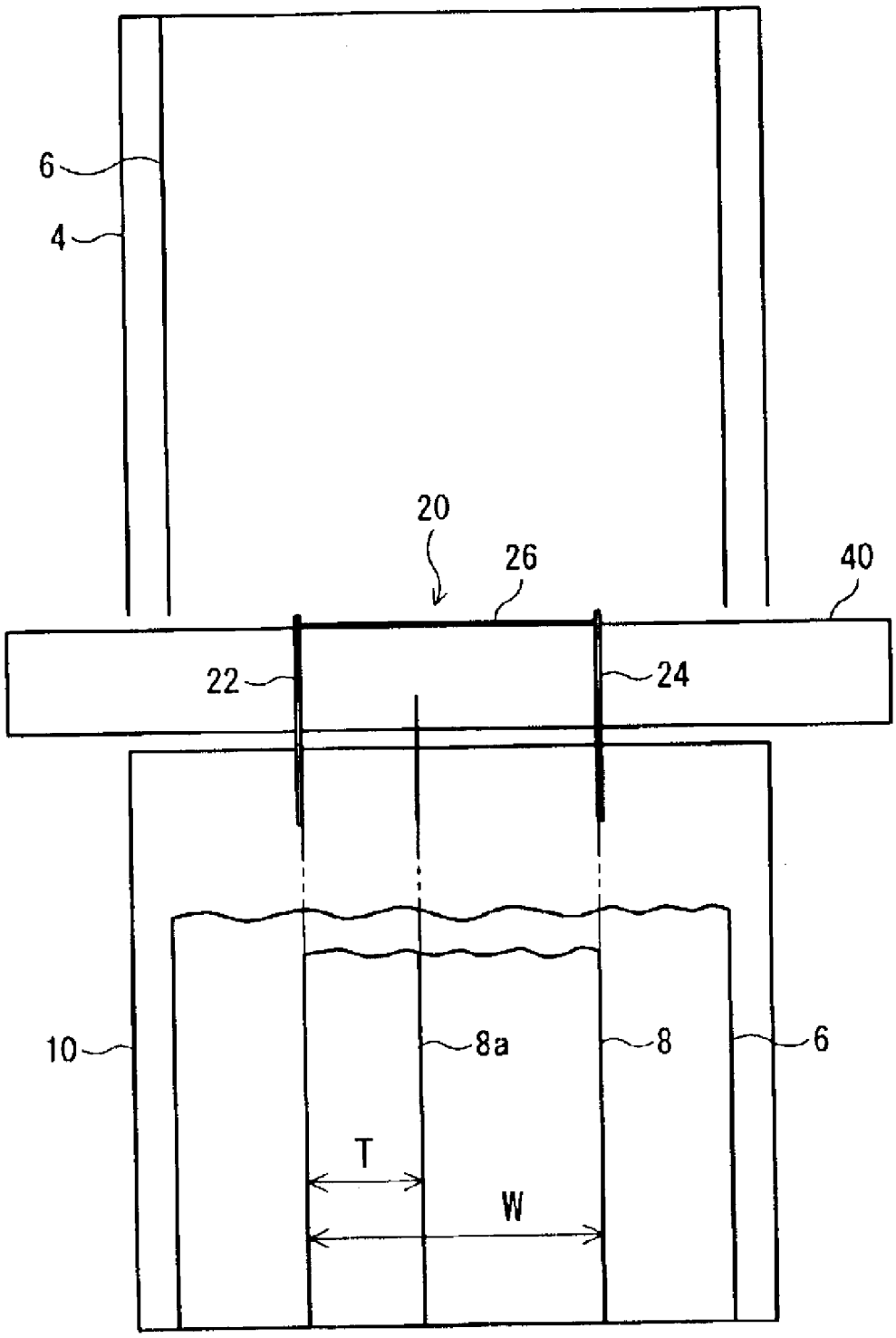
FIG. 10 is a front elevational view showing a configuration of the conventional dryer vacuum box.

FIGS. 1 and 2 show a dryer vacuum box as a first embodiment of the present invention. More particularly, FIG. 1 is a side elevational view, partly in section, showing a configuration of the dryer vacuum box according to the present embodiment, and FIG. 2 is a front elevational view of the dryer vacuum box. In FIGS. 1 and 2, like elements to those of the dryer vacuum box of the conventional dryer vacuum box described hereinabove with reference to FIGS. 9 and 10 are denoted by like reference numerals.

Referring to FIGS. 1 and 2, the dryer vacuum box of the present embodiment includes a novel vacuum box 30 in addition to a vacuum box 20 similar to that of the conventional dryer vacuum box. In the following description, the vacuum box 30 provided newly is referred to as a first vacuum box, and the vacuum box 20 similar that of the conventional dryer vacuum box is referred to as a second vacuum box. The second vacuum box 20 has a configuration as described hereinabove, and therefore overlapping description thereof is omitted herein to avoid redundancy.

In the present embodiment, novel brackets 44 and 46 are securely provided on a support pipe 40 as seen in FIG. 1. The brackets 44 and 46 are securely provided on the support pipe 40 with a gap left therebetween in upward and downward directions and extend toward a dryer roll 2 on the upstream side from the support pipe 40. Cross seals 32 and 34 are secured to end portions of the brackets 44 and 46, respectively, such that they extend in a widthwise direction of the apparatus. Further, each of the brackets 44 and 46 is assembled at one end thereof in a widthwise direction to a side seal 22 which composes the second vacuum box 20 (in FIG. 1, part of the side seal 22 is shown cutaway in order to show the inside of the second vacuum box 20) and has another side seal 36 assembled to the other end thereof. The cross seals 32 and 34 and the side seal 36 are held in contact with a canvas 6 wrapped around the dryer roll 2 and define an enclosed space 30 together with the side seal 22.

The contacting position between the upper side cross seal 32 and the canvas 6 is set to a position a little on the upstream side with respect to a peeling point at which the canvas 6 is spaced away from the dryer roll 2, and the contacting position between the lower side cross seal 34 and the canvas 6 is set to a position a little on the downstream side with respect to the peeling point. The enclosed space 30 is formed as a space which includes, as part of an inner face thereof, a surface of the canvas 6 in the proximity of the peeling point at which the canvas 6 is spaced away from the dryer roll 2. The enclosed space 30 functions as the first vacuum box 30.

A communication hole 40*a* for communicating an internal space 48 of the support pipe 40 and the inside of the first vacuum box 30 with each other is provided in a surface of the support pipe 40 between positions at which the brackets 44 and 46 are securely mounted on the support pipe 40. The internal space 48 of the support pipe 40 is connected to a vacuum fan (vacuum source) 50 and is used as a vacuum introduction path for allowing vacuum suction force to act on the inside of the first vacuum box 30 from the vacuum fan 50. Since the inside of the first vacuum box 30 is directly acted upon by vacuum suction force from the vacuum fan 50 in this manner, it can be controlled to a very high degree of vacuum when compared with the second vacuum box 20, which utilizes the vacuum suction force of vacuum roll 10. For example, if the negative pressure (gauge pressure) in a vacuum introduction path 12 of the vacuum roll 10 is set to 200 mmAq, then the insides of vacuum chambers 10*a*, 10*b* and 10*c* exhibit a negative pressure of approximately 50 mmAq, and the inside of the second vacuum box 20 exhibits a reduced negative pressure of approximately 10 mmAq. In contrast, since the inside of the first vacuum box 30 is acted upon by vacuum suction force through the vacuum introduction path 48 from the vacuum fan 50, it can be kept to a high negative pressure state of approximately 100 to 150 mmAq.

In the present embodiment, the contacting position between the upper side cross seal 32 and the canvas 6 is set to a position a little on the upstream side with respect to the peeling point at which the canvas 6 is spaced away from the dryer roll 2 (for example, at the position spaced by 50 mm on the upstream side from the peeling point) while the contacting position between the lower side cross seal 34 and the canvas 6 is set to another position a little on the downstream side with respect to the peeling point (for example, at the position spaced by 75 mm on the downstream side from the peeling point). By such locations of the cross seals 32 and 34, a strong vacuum suction force can be applied to a paper web 8 over a range from upstream to downstream of the peeling point at which the paper web 8 is spaced away from the dryer roll 2 (the peeling point when no sticking occurs). Consequently, the paper web 8 can be efficiently peeled from the dryer roll 2 because the occurrence of sticking is suppressed.

Particularly, in the present embodiment, the location of the first vacuum box 30 in the widthwise direction is set to a paper threading position of a tail 8*a* of the paper web 8, and the distance between the side seals 22 and 36 is set substantially equal to the width T of the tail 8*a*. Consequently, in the present embodiment, sticking of the tail 8*a* to the dryer roll 2, particularly upon paper threading, can be prevented, and the tail 8*a* can be threaded to the end readily without being taken by the dryer roll 2. Then, after the paper web 8 (tail 8*a*) passes by the peeling point, vacuum suction force can be applied to the paper web 8 (tail 8*a*) by the second vacuum box 20 making use of vacuum suction force of the vacuum roll 10, and therefore, the vacuum suction force can constrain the paper web 8 (tail 8*a*) to the canvas with certainty up to the vacuum roll 10, thereby stabilizing the running of the paper web 8 (tail 8*a*).

B. Second Embodiment

Figure 3:
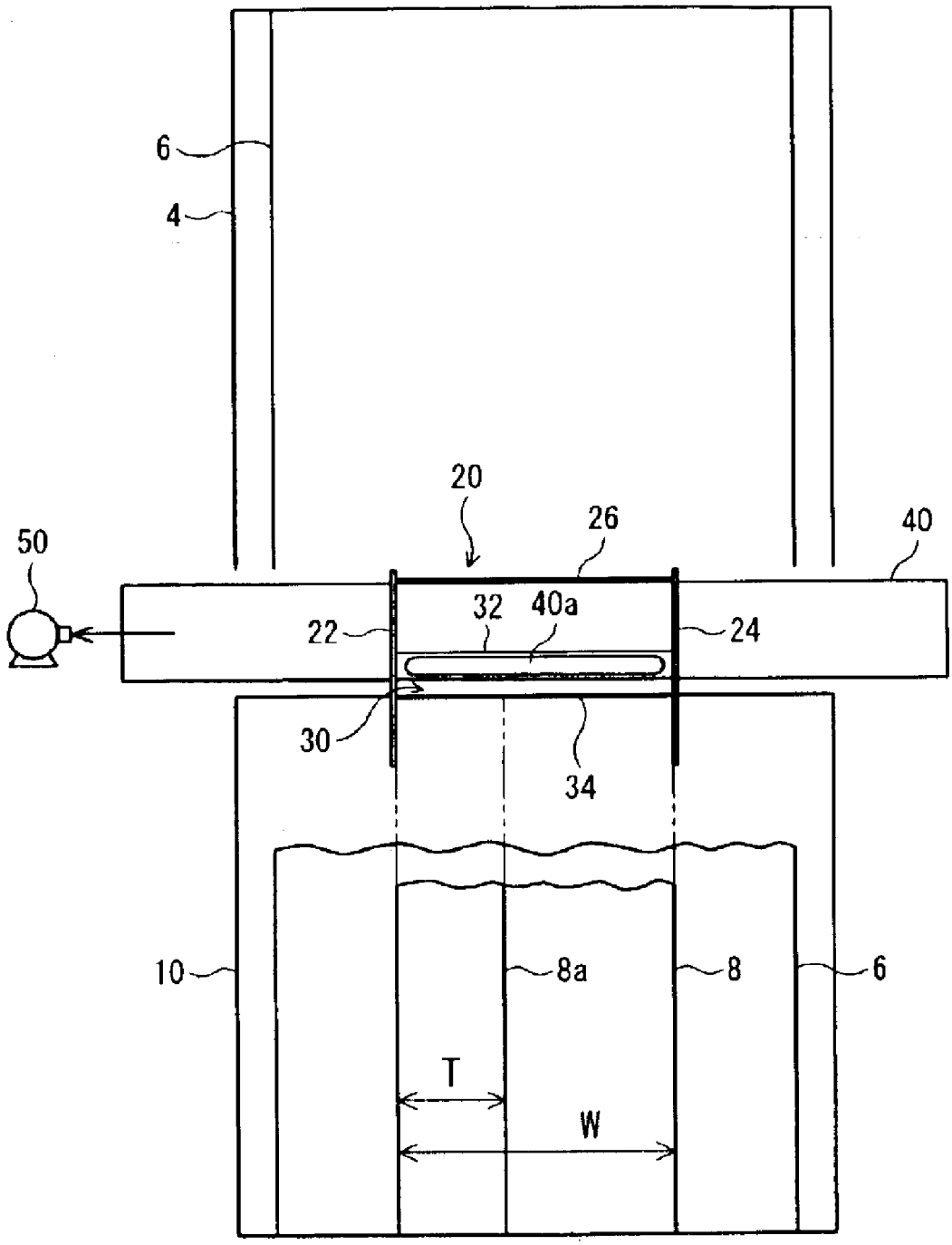
FIG. 3 is a front elevational view showing a configuration of a dryer vacuum box according to a second embodiment of the present invention.

Subsequently, a second embodiment of the present invention is described with reference to FIG. 3. FIG. 3 is a front elevational view showing a configuration of a dryer vacuum box according to the present embodiment. A side elevational view of the dryer vacuum box of the present embodiment is shown in FIG. 1 similarly to the dryer vacuum box of the first embodiment. It is to be noted that, in FIG. 3, like elements to those in the first embodiment are denoted by like reference characters.

The dryer vacuum box of the present embodiment is different in configuration of the first vacuum box 30 from that of the first embodiment as seen in FIG. 3. While, in the first embodiment, the width of the first vacuum box 30 is set substantially equal to the width T of the tail 8*a* in accordance with the paper threading position of the tail 8*a*, in the present embodiment, the width of the first vacuum box 30 is set equal to the full width W of the paper web 8. In particular, in the present embodiment, the central side seal 36 (refer to FIG. 2) in the first embodiment is not provided, but the cross seals 32 and 34 extend between the side seals 22 and 24 disposed in alignment with the opposite ends of the paper web 8. Naturally, though not shown, also the brackets 44 and 46 (refer to FIG. 1) which support the cross seals 32 and 34 thereon extend between the side seals 22 and 24.

With the dryer vacuum box having a configuration as described above, high vacuum suction force can be applied not only to the paper web 8 of the full width but also to the tail 8*a* of the paper web 8 upon paper threading.

It is to be noted that the dryer vacuum box of the present embodiment can be configured otherwise such that it includes only the first vacuum box 30 without the provision of the second vacuum box 20. Also in the modified configuration, vacuum suction force can be applied directly to the first vacuum box 30 from the external vacuum fan 50. Consequently, it is possible to set the negative pressure of the first vacuum box 30 to a sufficiently high degree of vacuum to peel the paper web 8 efficiently from the dryer roll 2, thereby to suppressing the occurrence of sticking.

C. Third Embodiment

Figure 4:
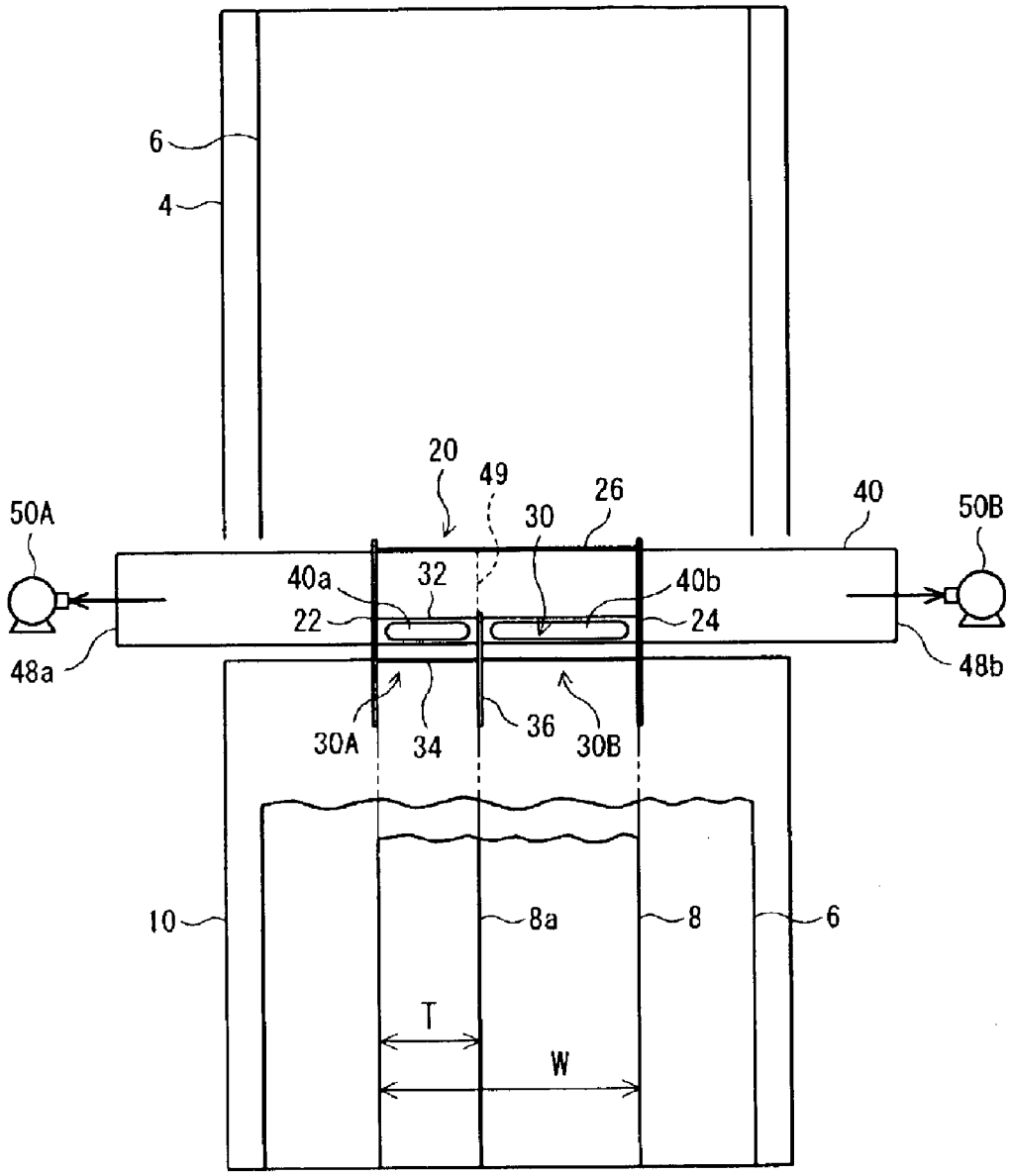
FIG. 4 is a front elevational view showing a configuration of a dryer vacuum box according to a third embodiment of the present invention.

Subsequently, a third embodiment of the present invention is described with reference to FIG. 4. FIG. 4 is a front elevational view showing a configuration of a dryer vacuum box according to the present embodiment. A side elevational view of the dryer vacuum box of the present embodiment is shown in FIG. 1 similarly to the dryer vacuumbox of the first embodiment. It is to be noted that, in FIG. 4, like elements to those in the first embodiment are denoted by like reference characters.

The dryer vacuum box of the present embodiment is different in configuration of the first vacuum box 30 from those of the first and second embodiments as seen in FIG. 4. In the present embodiment, the first vacuum box 30 has an installation width set equal to the full width W of the paper web 8 and is partitioned in a widthwise direction thereof into a first chamber 30A and a second chamber 30B. In particular, another side seal 36 is disposed between the side seals 22 and 24 disposed in alignment with the opposite ends of the paper web 8 such that the inside of the first vacuum box 30 is partitioned into two enclosed spaces, that is, the first chamber 30A and the second chamber 30B, by the side seal 36. The position of the side seal 36 is set such that the distance between the side seals 22 and 36 is substantially equal to the width T of the tail 8*a*.

Also the vacuum introduction path 48 in the support pipe 40 is partitioned into two vacuum introduction paths 48*a* and 48*b* by a partition- plate 49. The vacuum introduction path 48*a* and the first chamber 30A are communicated with each other by a communication hole 40*a* while the other vacuum introduction path 48*b* and the second chamber 30B are communicated with each other by another communication hole 40*b*. The vacuum introduction paths 48*a* and 48*b* are connected to different vacuum fans 50A and 50B, respectively.

With the configuration described above, since the first chamber 30A and the second chamber 30B can be connected to the vacuum fans 50A and 50B, which serve as different vacuum sources independent of each other, respectively, upon paper threading of the tail 8*a,* the required vacuum suction force can be applied to the paper threading position of the tail 8*a* by stopping the supply of the vacuum suction force from the vacuum fan 50B to the second chamber 30B. On the other hand, upon main operation of the dryer vacuum box wherein the paper web 8 is extended to the full width, by starting supply of the vacuum suction force from the vacuum fan 50B to the second chamber 30B, a high vacuum suction force can be applied uniformly to the full width of the paper web 8. In both cases, the occurrence of sticking can be suppressed.

It is to be noted that also the dryer vacuum box of the present embodiment can be modified such that it includes only the first vacuum box 30 without the provision of the second vacuum box 20, similarly to the second embodiment.

D. Fourth Embodiment

A dryer vacuum box in this embodiment is provided in a dryer part of a paper machine and is operable to apply vacuum suction force generated by a vacuum source through a canvas to a paper web, which is delivered with the canvas on a circumferential surface of a dryer roll. The dryer vacuum box comprises a first vacuum box having an opening faced with surrounding area of a peeling point on the canvas, where the canvas is separated from the circumferential surface of the dryer roll, and the opening is covered by the surrounding area of the canvas so that an enclosed space is defined within the first vacuum box. The first vacuum box is connected with the vacuum source so that the degree of vacuum in the first vacuum box can be set to a predetermined value.

The dryer vacuum box in this embodiment is explained in detail by following description.

Figure 5:
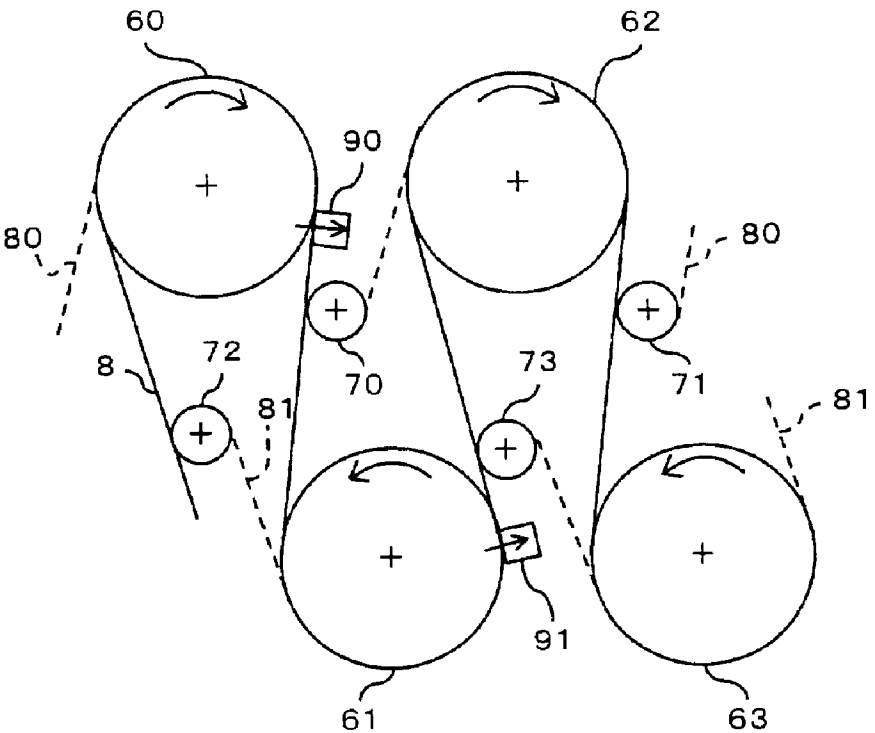
FIG. 5 is a side elevational view showing a configuration of a dryer part according to a fourth embodiment of the present invention.
Figure 6:
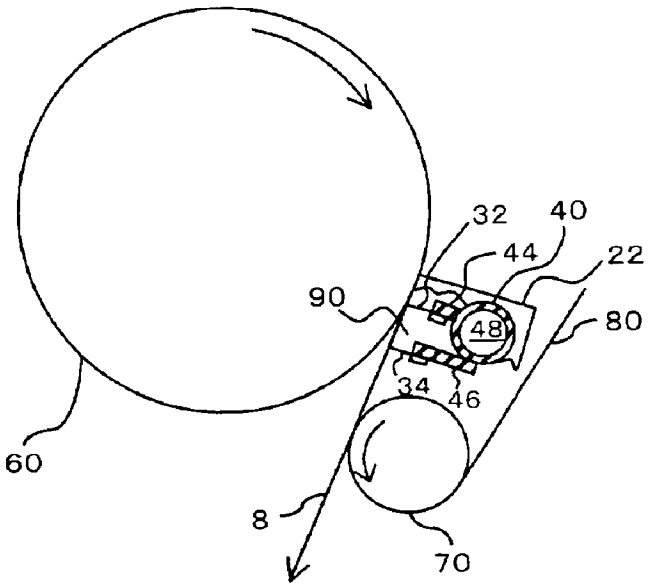
FIG. 6 is a side elevational view, partly in section, showing a configuration of a dryer vacuum box according to the fourth embodiment of the present invention.
Figure 7:
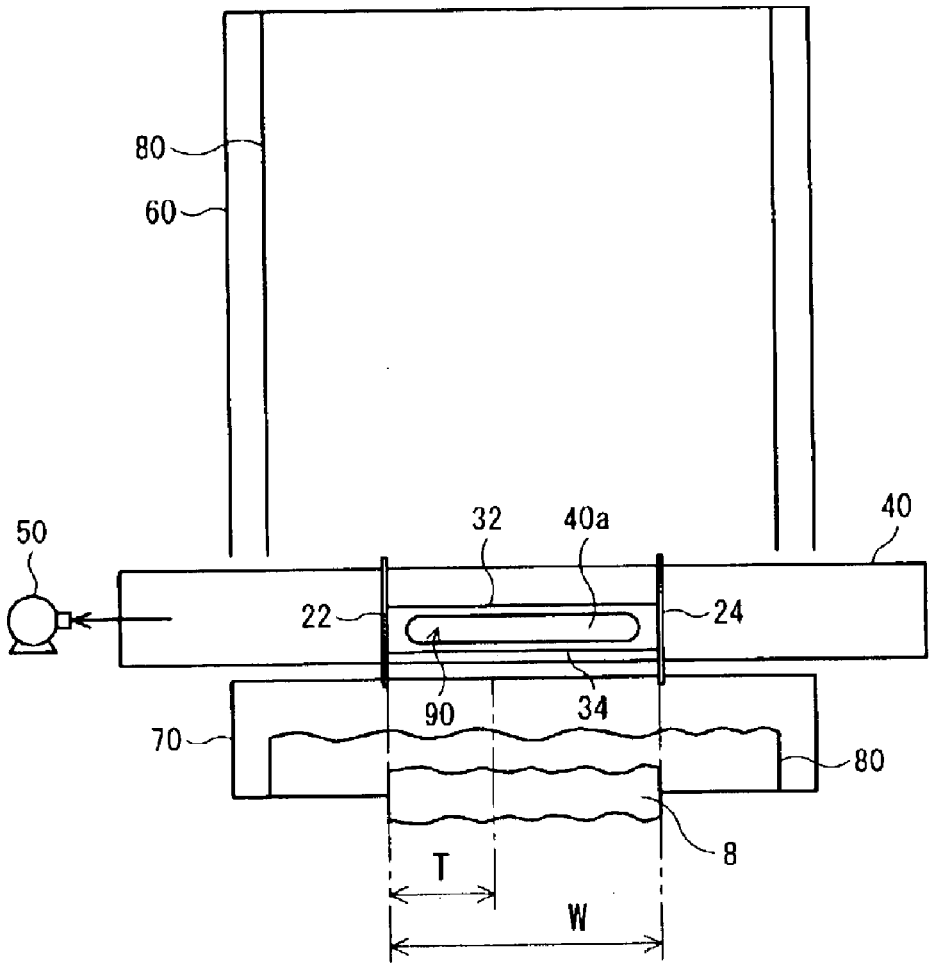
FIG. 7 is a front elevational view showing a configuration of the dryer vacuum box according to the fourth embodiment of the present invention.

FIGS. 5 to 7 are views showing a vacuum dryer box as a fourth embodiment of the present invention. More particularly, FIG. 5 is a schematic side elevational view showing a configuration of a dryer part in which the dryer vacuum box is incorporated, FIG. 6 is a schematic side elevational view, partly in section, showing a configuration of the dryer vacuum box, and FIG. 7 is a schematic front elevational view showing a configuration of the dryer vacuum box.

The dryer part shown is formed as that of the two-stage deck type wherein dryer rolls are disposed in two upper and lower stages. More particularly, the dryer part includes four dryer rolls 60 to 63. The dryer rolls (top dryer rolls) 60 and 62 are disposed in the upper stage while the dryer rolls (bottom dryer rolls) 61 and 63 are disposed in the lower stage.

An endless canvas 80 extends between and around the top dryer rolls 60 and 62 such that it runs in a loop while it is driven and/or guided by the top dryer rolls 60 and 62, canvas rolls 70 and 71 and so forth. Similarly, another endless canvas 81 extends between and around the bottom dryer rolls 61 and 63 such that it runs in a loop while it is driven and/or guided by the dryer rolls 61 and 63, canvas rolls 72 and 73 and so forth.

In the dryer part having the configuration described above, a paper web 8 is passed from the bottom canvas 81 to the top dryer roll 60. Thereupon, the paper web 8 is pressed to the top dryer roll 60 by the canvas 80. Then, the paper web 8 is spaced away from the canvas 80 on the canvas roll 70 and is now pressed to the bottom dryer roll 61 by the canvas 81. Therefore, the paper web 8 is pressed to the top dryer roll 62 by the canvas 80 and then pressed to the bottom dryer roll 63 by the canvas 81.

Vacuum boxes 90 and 91 are disposed between the top dryer roll 60 and the canvas roll 70 in the loop of the canvas 80 and between the bottom dryer roll 61 and the canvas roll 73 in the loop of the canvas 81, respectively.

The vacuum boxes 90 and 91 have a similar configuration to each other. Therefore, the configuration of the vacuum box 90, as a representative of the vacuum boxes 90 and 91, is described with reference to FIGS. 6 and 7. Between the top dryer roll 60 and the canvas roll 70, side seals 22 and 24 and brackets 44 and 46 are securely provided on a support pipe 40 which extends in a widthwise direction of the apparatus. Meanwhile, cross seals 32 and 34 are secured to end portions of the brackets 44 and 46, respectively, such that they extend in the widthwise direction.

As seen in FIG. 7, the opposite ends of the brackets 44 and 46 in the widthwise direction are assembled to the side seals 22 and 24 (in FIG. 6, the side seal 22 is shown partly cutaway in order to show the inside of the first vacuum box 90). The cross seals 32 and 34 and the side seals 22 and 24 are held in contact with the canvas 80 wrapped around the top dryer roll 60 in such a manner as to define an enclosed space 90. The enclosed space 90 functions as a vacuum box 90 (first vacuum box according to the present invention).

A communication hole 40*a* for communicating an internal space 48 of the support pipe 40 and the inside of the vacuum box 90 with each other is provided in a surface of the support pipe 40 between positions at which the brackets 44 and 46 are securely provided. The internal space 48 of the support pipe 40 is connected to a vacuum fan (vacuum source) 50.

In the present embodiment, similarly to the embodiments described hereinabove, the side seals 22 and 24 are disposed such that they are aligned with the opposite ends in the widthwise direction of the paper web 8 which runs on the dryer rolls, and the contacting position between the cross seal 32 on the upper side and the canvas 80 is set to a position a little on the upstream side with respect to a peeling point at which the canvas 80 is spaced away from the top dryer roll 60 while the contacting position between the cross seal 34 on the lower side and the canvas 80 is set to another position a little on the downstream side with respect to the peeling point.

In this manner, the vacuum box 90 is formed as an enclosed space which includes, as part of an inner face thereof, a surface of the canvas 80 in the proximity of the peeling point at which the canvas 80 is spaced away from the top dryer roll 60.

Since the vacuum box as the fourth embodiment of the present invention is configured in such a manner as described above, it has an advantage that it can prevent sticking similarly to those of the embodiments described hereinabove.

It is to be noted that, while the vacuum box of the present embodiment is configured such that it includes the vacuum boxes 90 and 91 (first vacuum boxes according to the present invention) each formed as a single member, it may otherwise be configured similarly to those of the embodiments described above such that a second vacuum box, which includes as part of an inner face thereof the surfaces of draw portions of the canvases 80 and 81 extending from the dryer rolls 60 and 61 to the canvas rolls 70 and 73 on the downstream side of the dryer rolls 60 and 61 in the paper web running direction, is provided on the outside of the first vacuum box. In this instance, for example, a support pipe separate from the support pipe 40 is mounted such that it extends through the second vacuum box and a negative pressure of a lower degree of vacuum than the negative pressure to be applied to the first vacuum box is applied to the inside of the second vacuum box through the support pipe.

Consequently, the paper web 8 can be sucked to the canvas not only in the proximity of but also around the peeling point (the peeling point when no sticking occurs) of the paper web 8 from the dryer roll. Besides, since such a high degree of vacuum as in the first vacuum box which peels the paper web 8 from the dryer roll is not required for the paper web 8 which has been peeled from the dryer roll, the second vacuum box can suck the paper web 8 efficiently with a degree of vacuum lower than that of the first vacuum box.

Also it is possible to modify the vacuum box of the fourth embodiment similarly to the third embodiment described hereinabove such that the side sea 136 is disposed such that the distance thereof to the side seal 22 is substantially equal to the width T of the tail 8*a* to partition the inside of the first vacuum box into a first chamber and a second chamber and supply vacuum suction force to the first chamber and the second chamber independently of each other.

E. Fifth Embodiment

Figure 8:
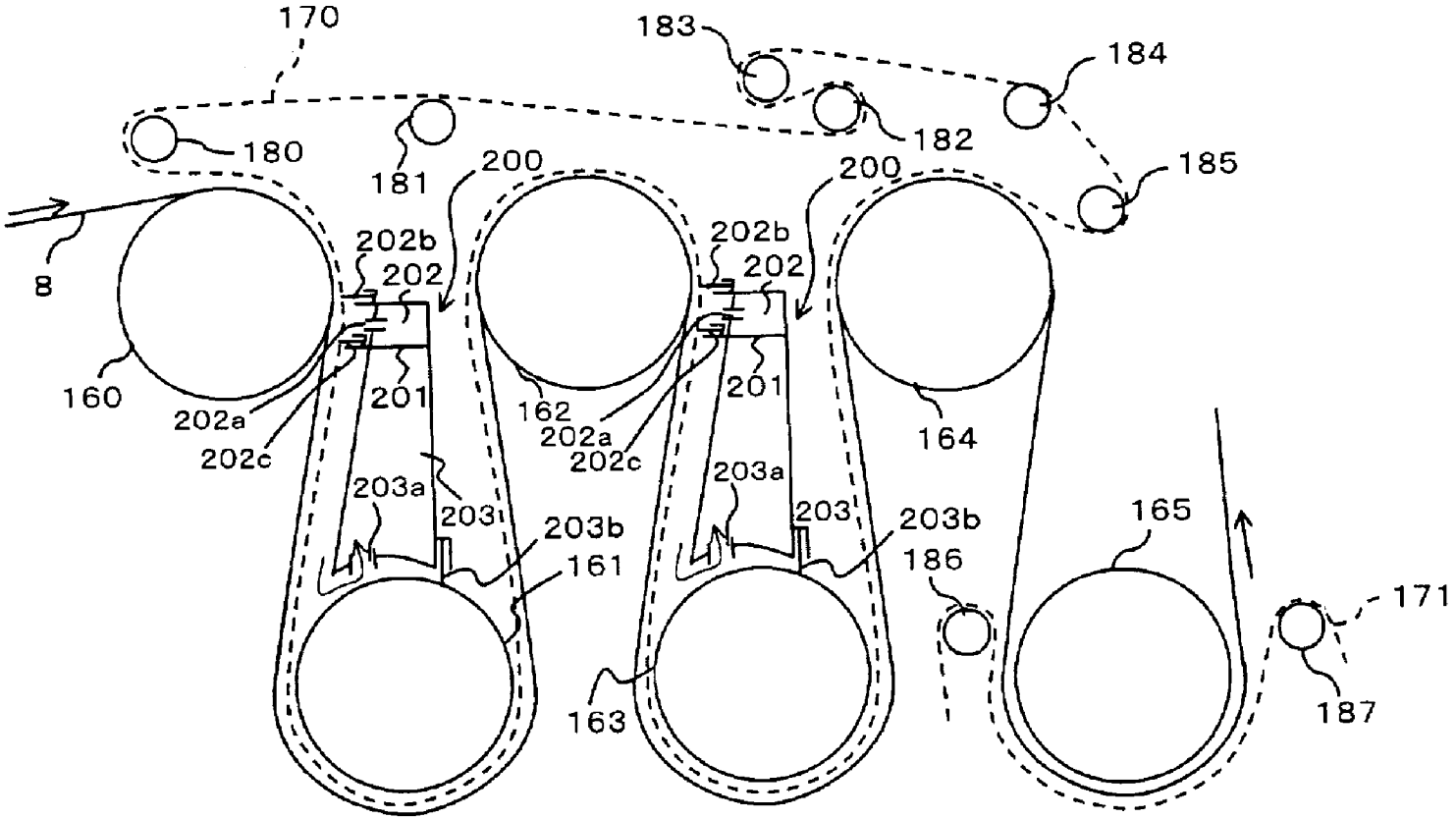
FIG. 8 is a schematic side elevational view showing a configuration of a dryer part according to a fifth embodiment of the present invention.

FIG. 8 is a schematic side elevational view showing a configuration of a dryer part in which a dryer vacuum box as a fifth embodiment of the present invention is incorporated. It is to be noted that, in FIG. 8, a gap is shown provided among a web 8, a canvas 170 and dryer rolls 161 to 163 for the convenience of illustration.

Figure 11:
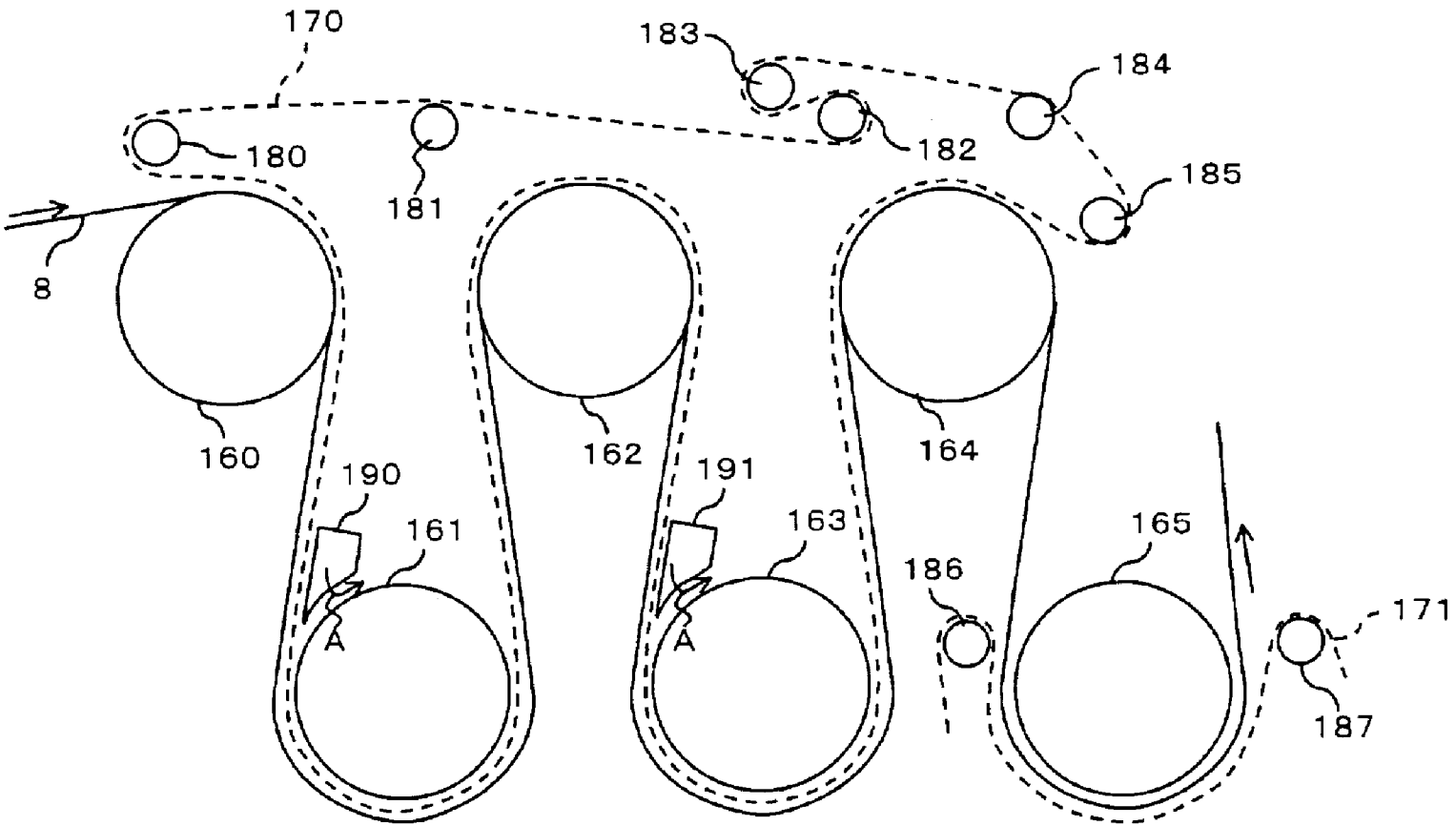
FIG. 11 is a side elevational view showing a configuration of a popular dryer part of the double deck type.

In the present embodiment, a dryer vacuum box of the present invention is incorporated in the dryer part of the double deck type described hereinabove as the prior art apparatus with reference to FIG. 11. Thus, those elements which have been described in the description of the prior art apparatus are denoted by like reference numerals and overlapping description of them is omitted herein to avoid redundancy.

In the present embodiment, a first vacuum box 200 is disposed between the dryer rolls 160 and 161 and also between the dryer rolls 162 and 163 in the loop of the canvas 170. Since both of the vacuum boxes 200 are configured similarly to each other, description is given below of a configuration of an upstream side one of the vacuum boxes 200 as a representative.

The vacuum box 200 is formed as an enclosed space which has a transverse sectional shape as seen in FIG. 8 and extends over the full width of the paper web 8. The vacuum box 200 is partitioned into a first chamber 202 and a second chamber 203 by a partition wall 201 disposed in the proximity of a peeling point at which the canvas 170 is peeled from the dryer roll 160.

A casing which forms the first chamber 202 has an opening 202a provided at a location thereof which faces the peeling point. A pair of cross seals 202b and 202c are attached to the casing at front and rear locations with respect to the opening 202*a* such that the contacting position between the cross seal 202*b* on the upstream side and the canvas 170 is set to a position a little on the upstream side with respect to the peeling point while the contacting position between the cross seal 202*c* on the downstream side and the canvas 170 is set to another position a little on the downstream side with respect to the peeling position.

Further, the casing which forms the second chamber 203 has, at a location thereof which faces the dryer roll 161, an opening 203*a* formed therein which is elongated in an axial direction of the dryer roll 161. A cross seal 203*b* is disposed on the opposite side to the cross seal 202*c* with respect to the opening 203*a*.

Different vacuum sources (not shown) are individually connected to the chambers 202 and 203 such that the inside of the first chamber 202 is controlled to a comparatively high degree of vacuum while the inside of the second chamber 203 is controlled to a comparatively low degree of vacuum.

Since the dryer vacuum box as the fifth embodiment of the present invention is configured in such a manner as described above, a high suction force can be applied to the paper web B through the canvas 170 between the cross seals 202*b* and 202*c* by the first chamber 202 to peel the paper web 8 from the dryer roll 160 with certainty, while the paper web 8 can be sucked stably to the canvas 170 between the cross seals 202*c* and 203*b* by the second chamber 203.

F. Others

While preferred embodiments of the present invention have been described, the present invention is not limited to the embodiments described above but can be carried out in various forms without departing from the spirit and scope of the present invention. For example, while the dryer vacuumbox of the third embodiment includes the vacuum fans 50A and 50B separate from each other as vacuum sources connected to the first chamber 30A and the second chamber 30B, respectively, it may be modified such that it includes a single vacuum fan and a control valve or valves are used to control the supply/stop of vacuum suction force from the vacuum fan to the first chamber 30A and the second chamber 30B independently of each other.

What is claimed is:

1. A dryer vacuum box in a dryer part of a paper machine for applying vacuum suction force from a vacuum source through a canvas to a paper web, the paper web traveling with the canvas on the circumferential surface of a dryer roll, said dryer vacuum box comprising:

a first vacuum box having an opening facing an area including a peeling point, the peeling point being the point at which the canvas together with the paper web leaves the circumferential surface of the dryer roll, wherein said opening is covered with the surface of the canvas in the area including the peeling point so that an enclosed space is defined by said first vacuum box and the canvas, said first vacuum box being connected to a vacuum source so that the degree of vacuum in said first vacuum box is adjustable, whereby a vacuum suction force can be applied to the canvas in the area surrounding the peeling point; and a second vacuum box having an opening facing a draw area of the canvas, the draw area lying between the dryer roll and another roll downstream of the dryer roll with respect to the paper web path, wherein said opening is covered with the draw area of the canvas so that another enclosed space is defined within said second vacuum box and a vacuum suction force is applied inside of said second vacuum box;

wherein said first vacuum box is inside of said second vacuum box and the degree of vacuum in said first vacuum box is set higher than in said second vacuum box.

2. The dryer vacuum box of claim 1, wherein the other roll is a vacuum roll and a vacuum suction force generated from said vacuum roll is applied to the inside of said second vacuum box.

3. The dryer vacuum box of claim 2, wherein said first vacuum box has a width substantially equal to the width of a tail of the paper web upon threading of the paper web and said first vacuum box is provided at a paper threading position of the tail.

4. The dryer vacuum box of claim 2, wherein said first vacuum box has a width substantially equal to the full width of the paper web.

5. The dryer vacuum box of claim 4, wherein said first vacuum box is internally partitioned in a widthwise direction into a first chamber and a second chamber which can be connected to the vacuum source independently of each other and said first chamber has a width substantially equal to the width of a tail of the paper web upon threading of the paper web and said first vacuum box is provided at a paper threading position of the tail.

6. The dryer vacuum box of claim 1, wherein said first vacuum box has a width substantially equal to the width of a tail of the paper web upon threading of the paper web and said first vacuum box is provided at a paper threading position of the tail.

7. The dryer vacuum box of claim 1, wherein said first vacuum box is internally partitioned in a widthwise direction into a first chamber and a second chamber which can be connected to the vacuum source independently of each other and said first chamber has a width substantially equal to the width of a tail of the paper web upon threading of the paper web and said first vacuum box is provided at a paper threading position of the tail.

8. The dryer vacuum box of claim 1, wherein said first vacuum box has a width substantially equal to the width of a tail of the paper web upon threading of the paper web and said first vacuum box is provided at a paper threading position of the tail.

9. The dryer vacuum box of claim 1, wherein said first vacuum box has a width substantially equal to the full width of the paper web.

10. The dryer vacuum box of claim 9, wherein said first vacuum box is internally partitioned in a widthwise direction into a first chamber and a second chamber which can be connected to the vacuum source independently of each other and said first chamber has a width substantially equal to the width of a tail of the paper web upon threading of the paper web and said first vacuum box is provided at a paper threading position of the tail.

11. The dryer vacuum box of claim 1, wherein said first vacuum box is internally partitioned in a widthwise direction into a first chamber and a second chamber which can be connected to said vacuum source independently of each other.

12. The dryer vacuum box of claim 1, wherein enclosed space of said first vacuum box is defined by the canvas, upper and lower cross seals positioned upstream and downstream of the peeling point, respectively, and side seals.

13. The dryer vacuum box of claim 12, wherein a second vacuum box has said first vacuum box inside thereof, said second vacuum box having an opening facing a draw area of the canvas, the draw area lying between the dryer roll and another roll downstream of the dryer roll with respect to the paper web path, wherein said opening is covered with the draw area of the canvas so that another enclosed space is defined within said second vacuum box and a vacuum suction force is applied inside of said second vacuum box, and wherein the degree of vacuum in said first vacuum box is higher than in said second vacuum box.

* * * * *